US006237667B1

(12) United States Patent
Fraczek et al.

(10) Patent No.: US 6,237,667 B1
(45) Date of Patent: May 29, 2001

(54) ROLLER SHADE TUBE WITH EXTENSION WING

(75) Inventors: Richard R. Fraczek, Stamford; David M. Cross, Westport, both of CT (US)

(73) Assignee: RollEase, Inc., Stamford, CT (US)

( * ) Notice: Subject to any disclaimer, the term of this patent is extended or adjusted under 35 U.S.C. 154(b) by 0 days.

(21) Appl. No.: 09/572,034

(22) Filed: May 16, 2000

Related U.S. Application Data

(60) Provisional application No. 60/141,638, filed on Jun. 30, 1999.

(51) Int. Cl.[7] ..... E06B 9/08
(52) U.S. Cl. ..... 160/121.1; 160/84.05
(58) Field of Search ..... 160/84.01, 84.05, 160/84.04, 121.1

(56) References Cited

U.S. PATENT DOCUMENTS 2,029,675 * 2/1936 Schlamp .
2,267,869 * 12/1941 Loehr .
4,194,550 * 3/1980 Hopper ..... 160/121.1
5,320,154 * 6/1994 Colson et al. ..... 160/84.05
5,855,235 * 1/1999 Colson et al. .

* cited by examiner

*Primary Examiner*—Blair M. Johnson
(74) *Attorney, Agent, or Firm*—Gottlieb, Rackman & Keisman, P.C.

(57) ABSTRACT

An improved roller shade tube assembly is provided. The assembly includes a roller or tube member having an outside surface around which a fabric shade is wound. The fabric shade has outside and inside sheets between which are a series of fabric slats. The assembly also includes an extension wing element having one end that is pivotally connected to the outside surface of the roller member and a second opposite end to which one of the fabric sheets is attached.

23 Claims, 7 Drawing Sheets

ROLLER SHADE TUBE WITH EXTENSION WING

This application claim benefit to provisional application 60/141,638 Jun. 30, 1999.

BACKGROUND OF THE INVENTION

This invention relates to an improved roller shade tube assembly, and more particularly, to a roller shade tube assembly having an extension wing for supporting a shade or fabric.

In the marketplace, it is very desirable to use fabrics in window covering systems. In most conventional systems, the fabrics are operated on or otherwise wound about a roller shade tube which is located inside a headrail unit. The fabric typically consists of an inside and outside sheet between which a series of light-blocking or light-diffusing slats are connected.

When the shade or fabric is lowered, it is desirable to have the light-blocking or light-diffusing slats turned substantially perpendicular to the window (or parallel to the floor) in order to allow the maximum amount of light into the room. In order to do so, in prior art systems, the tube onto which the shade or fabric is wound would have a diameter size which is at least as large as the width of the fabric slats.

In that regard, in current systems offered by the companies Comfortex and Levolor, the roller shade tube assembly utilizes a larger diameter tube design of approximately 1 ½ inches. In the current Silhouette system being offered for sale by Hunter Douglas, the light-blocking slats are turned perpendicular to the window by utilizing a tube that has permanent extensions, effectively rendering the diameter of the tube approximately 1 ⅜ inches.

As can be appreciated, the problem with current roller shade systems is that they require large diameter tubes, which necessitates the need for a large high profile headrail system. While it is possible, from a weight stand-point, to have a roller shade supported on a tube of a smaller diameter, a smaller sized tube does not have sufficient diameter to effect the turning of the slats so that they are directed perpendicular to the window. As a result, the headrail which carries the tube is typically greater than 2 inches or more in height in prior art systems, which consumers find to be somewhat unattractive. Moreover, because both the rail and tube are of a large size, cost is increased in manufacture and production.

Accordingly, it would be desirable to provide a roller shade tube assembly which can operate a suspended fabric shade so that the light-blocking slats may be turned perpendicular to a window, yet have a tube size to enable a low profile headrail design.

SUMMARY OF THE INVENTION

Generally speaking, in accordance with the invention, an improved roller shade tube assembly is provided. The assembly includes a roller or tube member having an outside surface around which a fabric shade is wound. The fabric shade has outside and inside sheets between which are a series of fabric slats. The assembly also includes an extension wing element having one end that is pivotally connected to the outside surface of the roller member and a second opposite end to which one of the fabric sheets is attached.

As can be appreciated from an understanding of the invention, by utilizing an extension wing that is pivotally connected to the outside surface of the roller member, it is possible to use tubes having a tube diameter far smaller than in prior art designs. In operation, once the fabric shade has been unwound from the roller member and is in a fully down position, the extension wing pivots away from the roller and thereby allows the slats of the shade to be rotated so that they are disposed substantially perpendicular with respect to the window. In addition, the extension wing may be used as a stop mechanism, preventing the fabric shade from winding around the roller or tube member in an opposite direction, which, if allowed to happen, could damage the fabric shade.

Accordingly, it is an object of the invention to provide an improved roller shade tube system.

Still another object of the invention is to provide a roller shade tube system which enables the slats of the fabric shade to be turned substantially perpendicular with respect to the window.

Yet another object of the invention is to provide an improved roller shade tube system which enables the utilization of a low profile headrail.

Still a further object of the invention is to provide an improved roller shade tube system that is less expensive to produce.

Still other objects and advantages of the invention will in part be obvious and will in part be apparent from the following description.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENTS

Figure 1A:
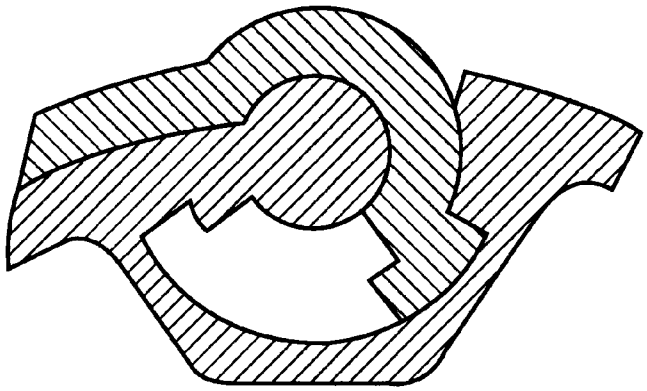
FIG. 1 is a cross-sectional view of the inventive roller shade tube assembly with the extension wing in a completely retracted position.

Referring to FIGS. 1–6, a roller shade tube assembly made in accordance with the invention and generally indicated at 11 is described. Tube assembly 11 comprises a tube 13 made of a metal extrusion such as aluminum and having an outside surface around which a fabric shade 23 is selectively wound and unwound. Tube 13 is formed with a arcuate recessed portion 15 for accommodating an extension wing 17. Extension wing 17 is formed with a hinge portion 19 which is pivotally rotatable about a bulb 21 of recessed portion 15.

Figure 1:
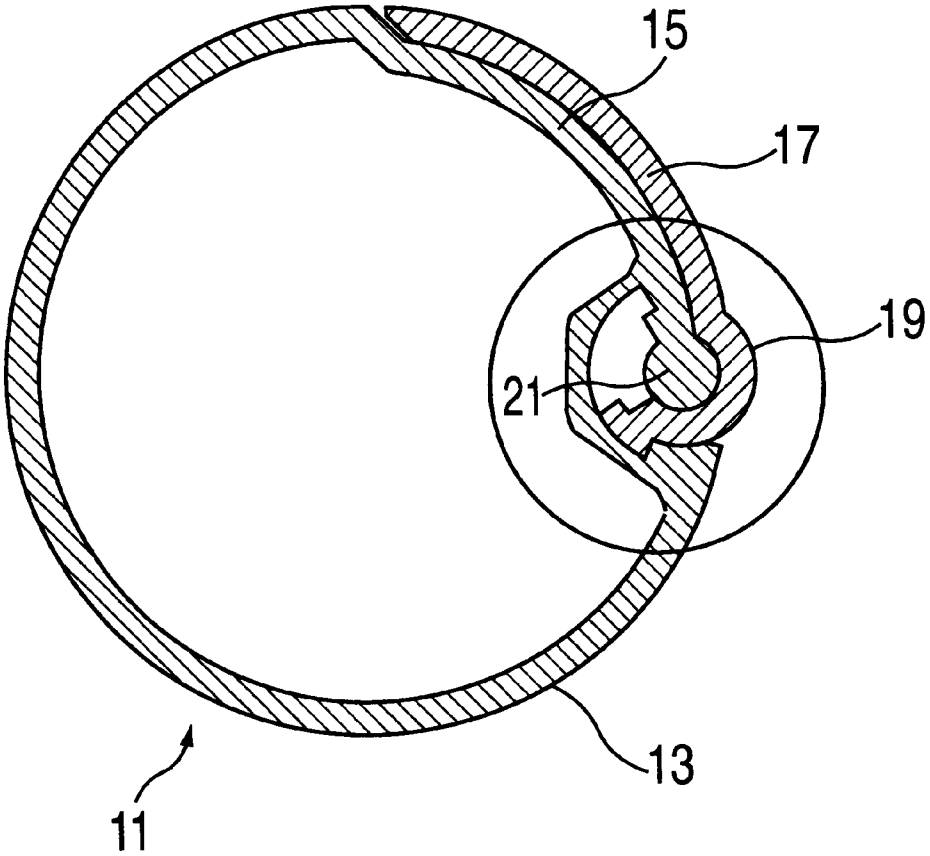
Figure 2A:
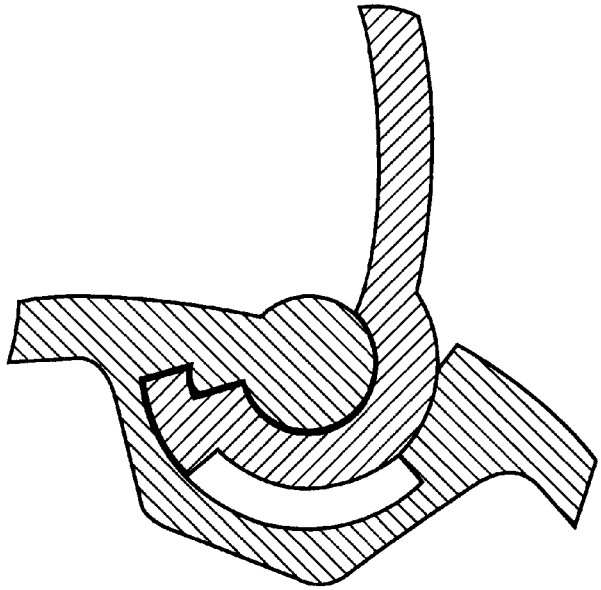
FIG. 2 is a cross-sectional view of the roller shade tube assembly of the invention with the extension wing fully extended.
Figure 2:
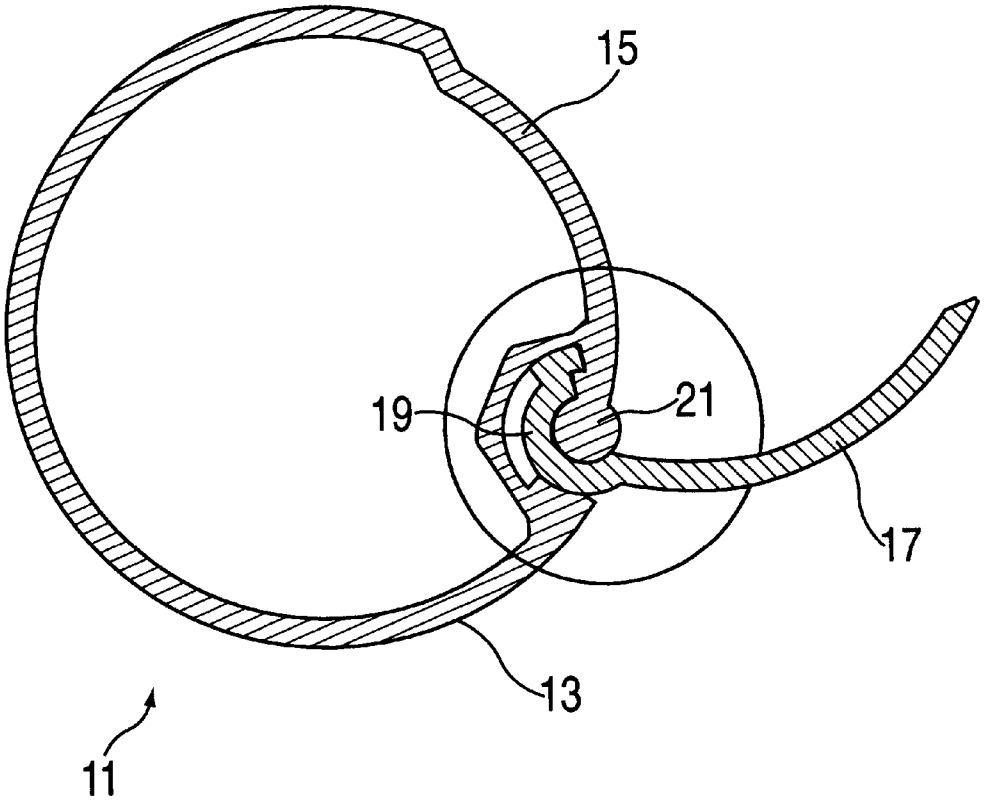
Figure 3:
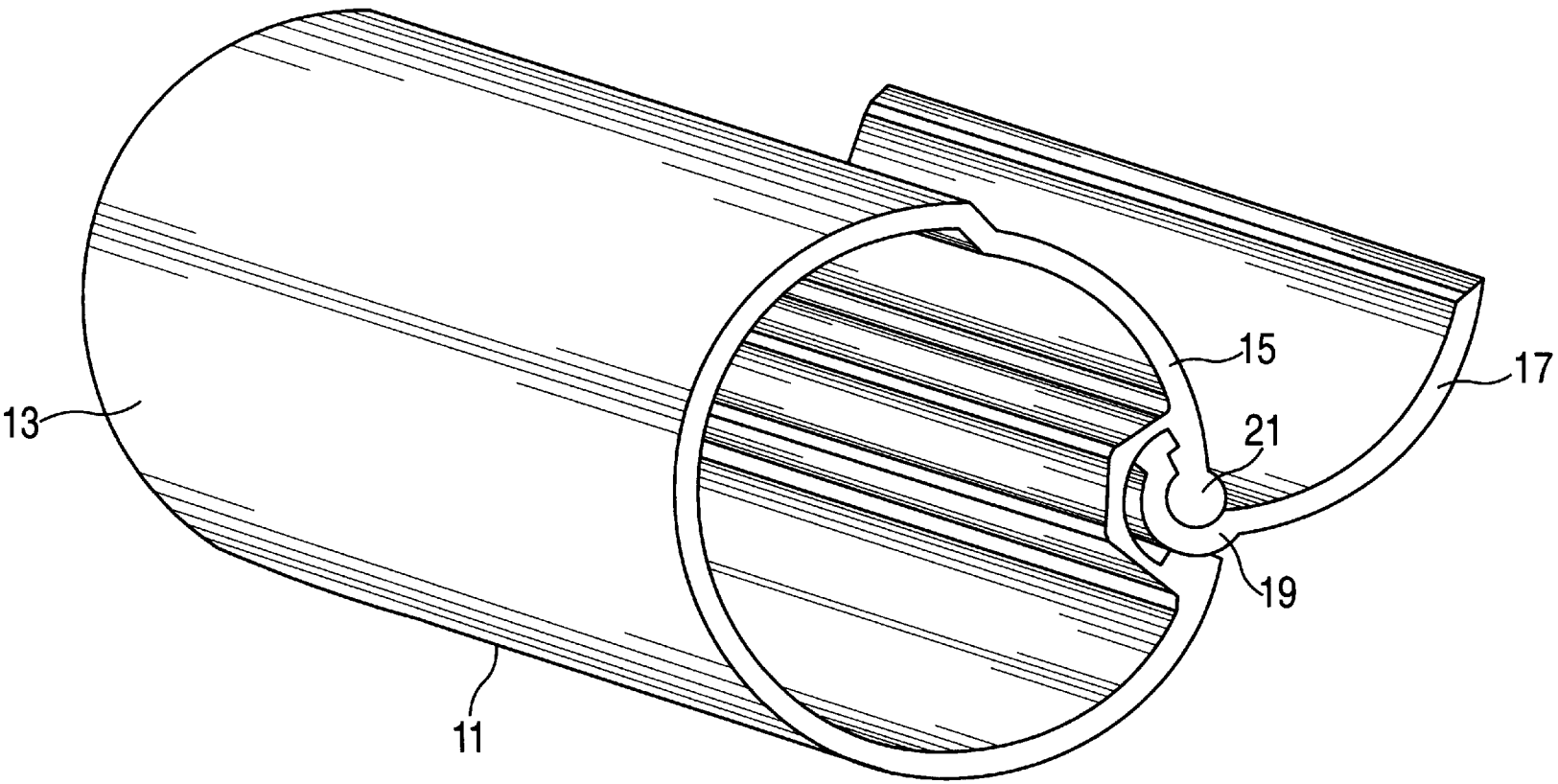
FIG. 3 is a perspective view of the roller shade tube assembly of the invention.

In FIG. 1, extension wing 17 is shown in a fully retracted condition and is fitted over or along recessed portion 15. In FIGS. 2 and 3, extension wing 17 has been pivotally rotated to a substantially fully extended condition which enables tube assembly 11 to support fabric shade 23 in an open condition, as described below.

Figure 4:
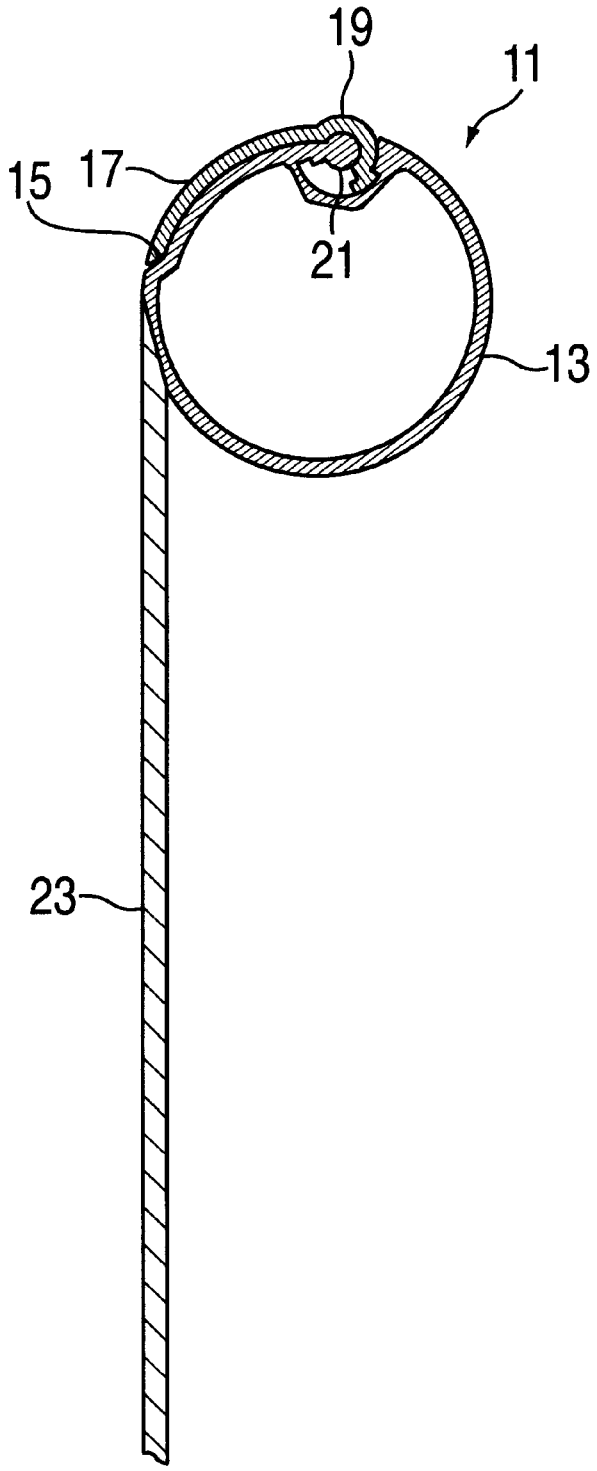
FIG. 4 is a cross-sectional view of the roller shade tube assembly of the invention with the extension wing fully retracted and showing the fabric shade partially unwound.
Figure 5:
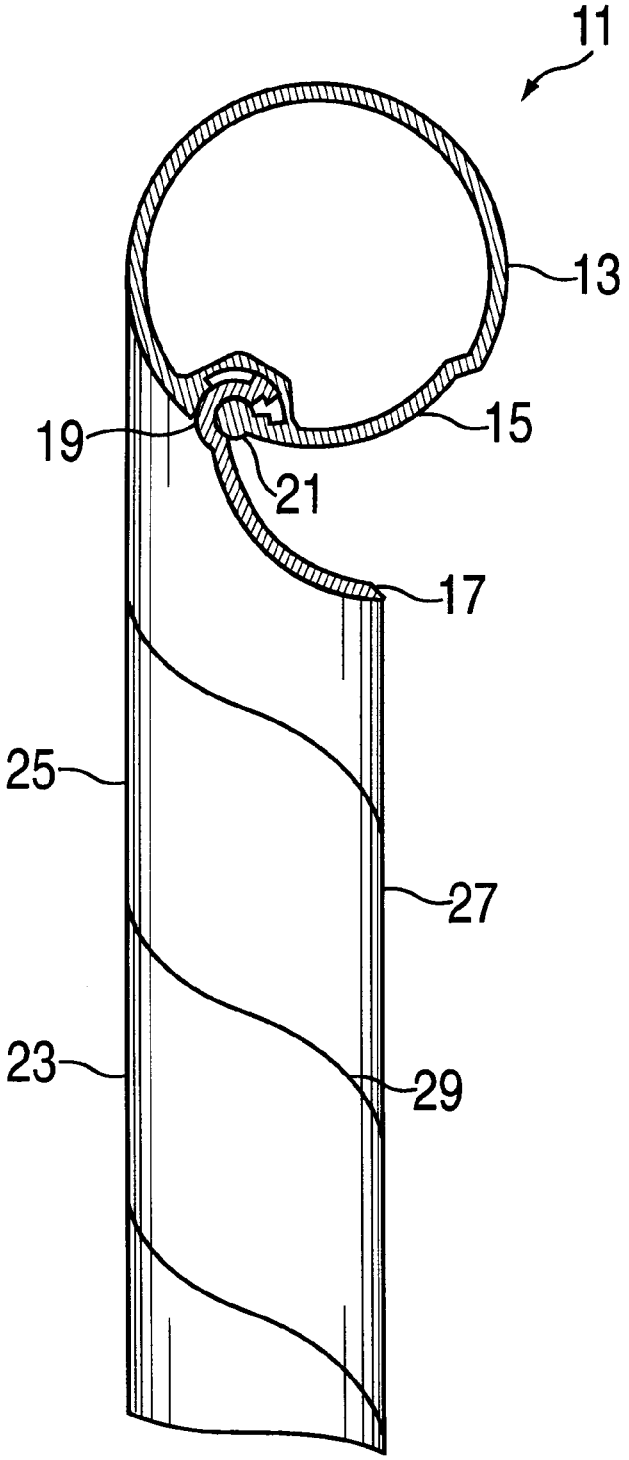
FIG. 5 is a cross-sectional view of the roller shade tube assembly of the invention with the extension wing partially extended and the fabric shade almost completely lowered.
Figure 6:
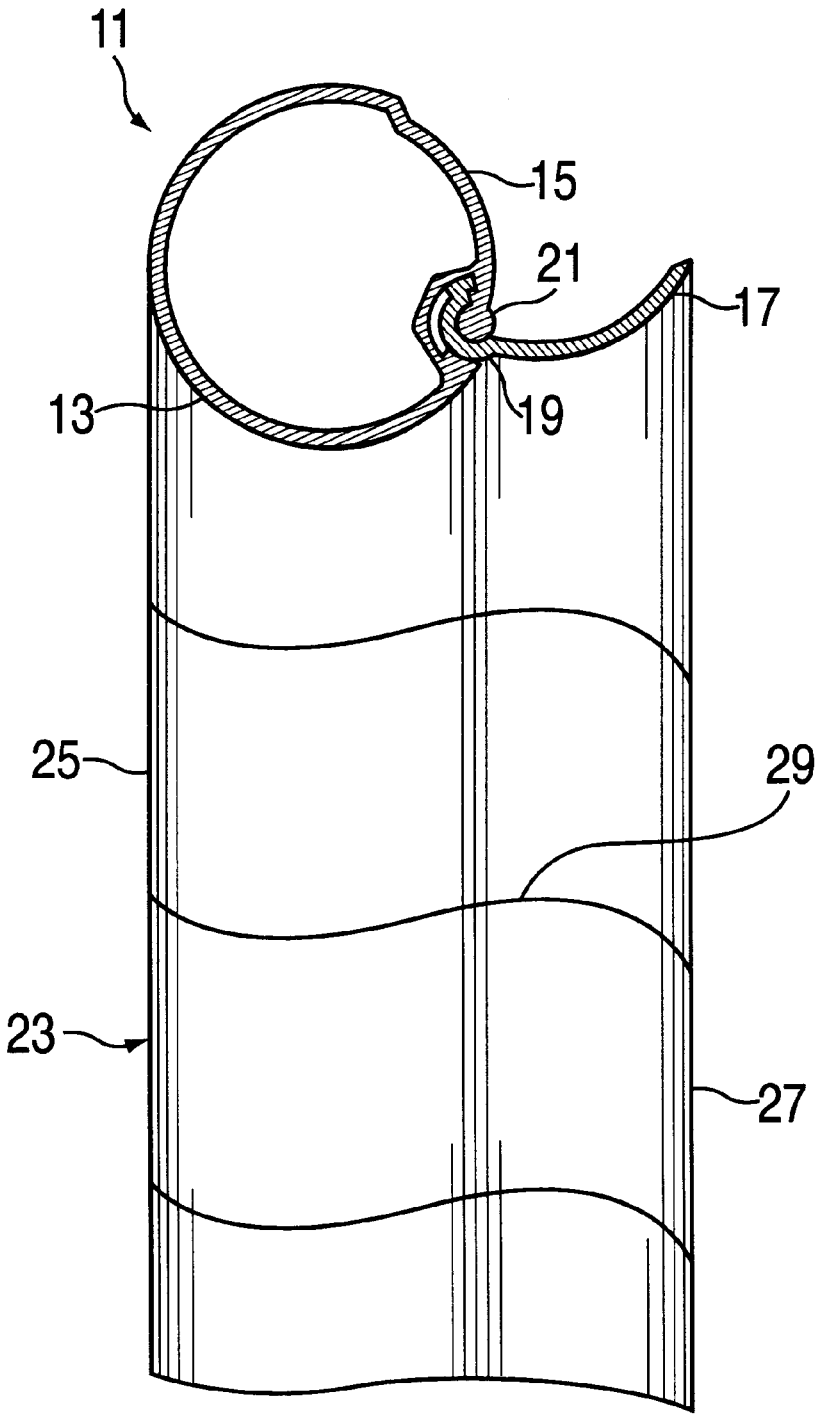
FIG. 6 is a cross-sectional view of the roller shade tube assembly of the invention with the extension wing completely extended and the fabric shade completely unwound.

Referring specifically now to FIGS. 4–6, fabric shade 23 is defined by an outside sheet 25, an inside sheet 27, and a plurality of fabric slats 29 extending between sheets 25 and 27. As is best shown in FIGS. 5 and 6, the top end of outside sheet 25 is attached to tube 13 along the surface thereof, while the top end of fabric sheet 27 is attached to the tip or end of extension wing 17.

When fabric shade 23 is being wound or unwound about roller shade tube 13, as shown in FIG. 4, extension wing 17 is disposed in a fully retracted position along recessed portion 15. Just before fabric shade 23 is fully lowered, extension wing 17 begins to pivotally rotate away from recessed portion 15, as shown in FIG. 5, thereby causing the separation of sheets 25 and 27 from each other. In FIG. 6, fabric shade 23 is shown in a completely lowered condition with extension wing 17 fully extended. As a result, fabric sheets 25 and 27 of shade 23 are fully separated from each other such that fabric slats 29 are disposed in a perpendicular direction with respect to sheets 25 and 27. Since slats 29 are made of a light-blocking or light-diffusing material such as a non-woven or woven polyester, when disposed in a perpendicular direction as shown in FIG. 6, light is able to pass through fabric sheets 25 and 27 of shade 23.

As can be appreciated, especially from viewing FIG. 6, a smaller diameter tube may be used to accommodate a fabric shade which, when fully lowered, has a width substantially greater than the diameter of the tube. This is because of the use of extension wing 17, as previously described. As a result, the inventive system may be incorporated into or with a low-profile headrail, which consumers generally find to be substantially more attractive.

In addition, because a smaller tube (and, in turn, headrail) is needed when utilizing the invention, less material is needed to produce the tube and headrail, which may reduce product costs.

Furthermore, the inventive roller shade tube reduces the "holding strength" required to hold the fabric shade in place, thereby creating a lighter feel for operation. In other words, a lower weight clutch unit may be used because the roller shade tube diameter has been substantially reduced. This is because a smaller diameter tube requires the clutch or brake mechanism to supply less torque in order to support the same size shade.

Figure 7:
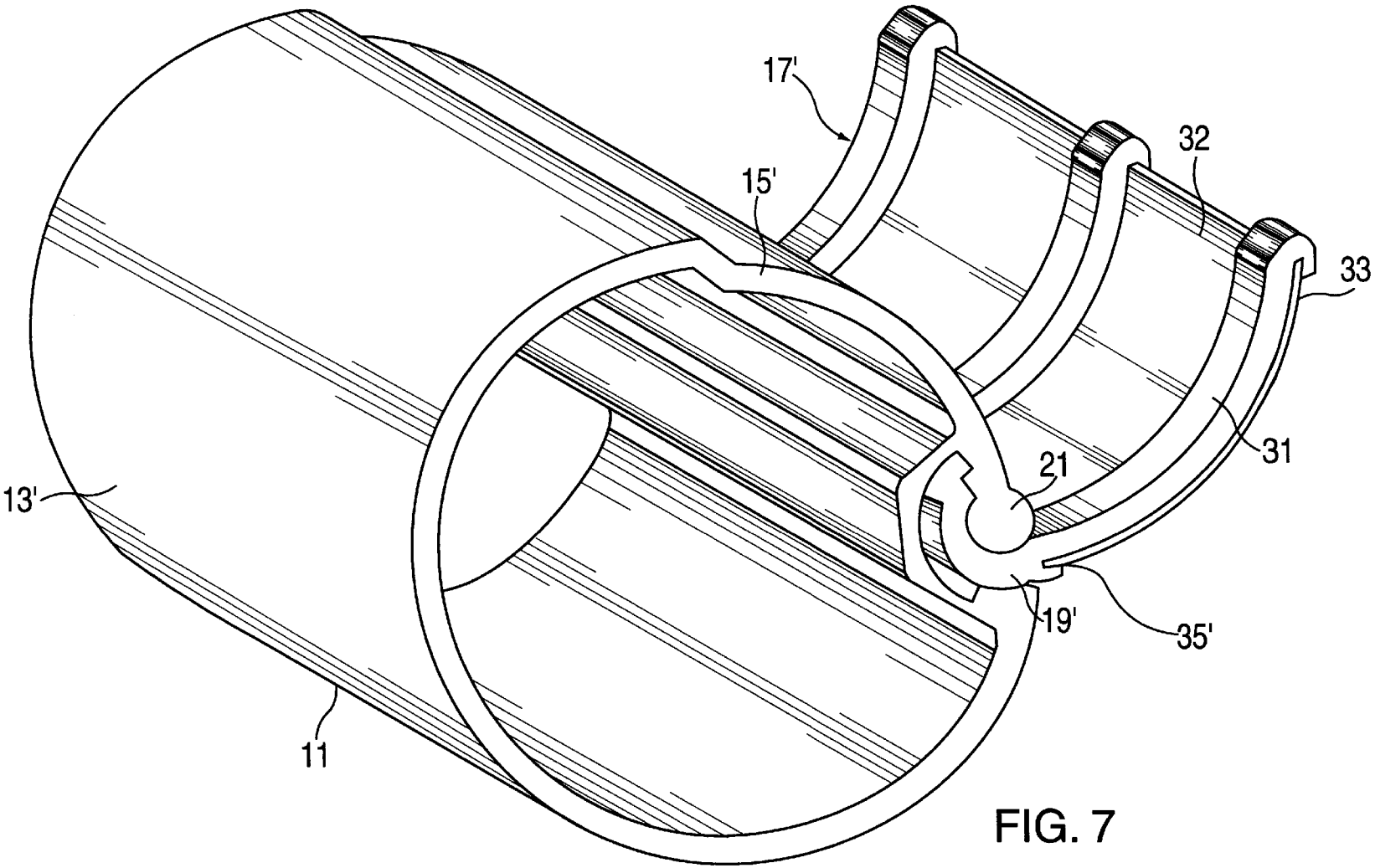
FIG. 7 is a perspective view of an alternate embodiment of the roller shade tube of the invention.

Referring now to FIG. 7, a second embodiment of the roller shade tube assembly is described and generally indicated at 11'. Assembly 11' comprises a tube 13' having an arcuate recessed portion 15' for accommodating wing 17'. Wing 17' is formed with a hinge portion 19' pivotally rotatable about a bulb 21' of recessed portion 15', as described before. Significantly, wing 17' of assembly 11' comprises a series of arcuate segments 31 made preferably from aluminum or molded plastic and each formed with two underlying slots 33 and 35. A stiffener element 32 preferably made of polycarbonate material or aluminum, (similar to a Venetian blind slat) is received within slots 33 and 35 of segments 31 and runs the entire length of tube 13'.

Assembly 11' is particularly suitable when the tube thereof is long in dimension, as it aids assembly and eliminates potential friction and binding between the tube and the wing assembly.

It will thus be seen that the objects set forth above, among those made apparent from the preceding description, are efficiently attained. Certain changes may be made in the invention without departing from the spirit and scope thereof. It is further noted that the scope of protection is set forth in the claims.

What is claimed is:

1. A roller shade tube assembly comprising a fabric shade, a roller having an outside surface around which said fabric shade is selectively wound thereabout, and an extension wing having one end pivotally connected to the outside surface of said roller, and from which said fabric shade is at least partially supported, said extension wing comprising a series of segments and a stiffening element retained by said segments and running the length of said wing.

2. The assembly of claim 1, wherein said fabric shade comprises a first fabric sheet, a second fabric sheet and a plurality of fabric slats extending between said sheets.

3. The assembly of claim 2, wherein one of said fabric sheets is supported along the outside surface of said roller and the other of said fabric sheets is supported by said extension wing.

4. The assembly of claim 1, wherein said extension wing is pivotally hinged to said outside surface of said tube.

5. The assembly of claim 1, wherein said roller includes a recessed portion along the outside surface thereof for selectively accommodating said extension wing.

6. The assembly of claim 5, wherein said extension wing is pivotal between a retracted position disposed along said recessed portion of said outer surface and an extended position.

7. The assembly of claim 2, wherein said fabric slats are oriented perpendicularly with respect to said fabric sheets when said extension wing is fully extended.

8. A roller shade tube assembly comprising an elongated roller having an outside surface and an extension wing extending substantially the length of said roller and being pivotally connected at one end to said surface and comprising a series of segments and a stiffening element retained by said segments and running the length of said wing.

9. A roller shade tube assembly comprising a roller having an outside surface around which a fabric shade may be wound thereabout and an extension wing pivotally connected at one end to said surface and pivotal between a retracted position in which said wing is disposed substantially entirely in a recessed portion along said surface and an extended position in which said wing is disposed away from said surface.

10. The assembly of claim 9, wherein said extension wing is pivotally hinged to said outside surface of said tube.

11. The assembly of claim 9, wherein said roller includes a recessed portion along the outside surface thereof for selectively accommodating said extension wing.

12. The assembly of claim 11, wherein said extension wing is pivotal between a retracted position along said recessed portion of said outer surface and an extended position.

13. The assembly of claim 12, wherein said extension wing comprises a series of segments and a stiffening element retained by said segments and running the length of said wing.

14. The assembly of claim 12, wherein said extension wing is connected at one end to said outside surface of said roller by means of a pivot mechanism located at said one end.

15. The assembly of claim 14, wherein said hinge mechanism includes a stop for preventing said extension wing from pivoting past said extended position.

16. A roller shade tube assembly comprising a fabric shade, a roller having an outside surface around which said fabric shade is selectively wound thereabout and an extension wing having one end pivotally connected to the outside surface of said roller and from which said fabric shade is at least partially supported;

wherein said extension wing is pivotal between a retracted position in which said wing is disposed substantially entirely in a recessed portion along said outside surface and an extended position in which said wing is disposed away from said surface.

17. The assembly of claim 16, wherein said fabric shade comprises a first fabric sheet, a second fabric sheet and a plurality of fabric slats extending between said sheets.

18. The assembly of claim 17, wherein one of said fabric sheets is supported along the outside surface of said roller and the other of said fabric sheets is supported by said extension wing.

19. The assembly of claim 16, wherein said extension wing is connected at one end to said surface of said roller by means of a pivot mechanism.

20. The assembly of claim 19, wherein said hinge mechanism includes a stop for preventing said wing from pivoting beyond said retracted position.

21. A roller shade tube assembly comprising an elongated roller having an outside surface and an extension wing extending substantially the length of said roller and being pivotally connected at one end to said surface so as to pivot between a retracted position and an extended position in which said wing extends away from said surface;

wherein said extension wing is connected to said surface by means of a pivot mechanism located at said one end and including a stop member for preventing said extension wing from pivoting beyond said extended position.

22. The assembly of claim 21, wherein said roller includes a recessed portion along the outside surface thereof for selectively accommodating said extension wing along said surface when said wing is in a retracted position.

23. A roller shade tube assembly comprising a fabric shade, an elongated roller having an outside surface around which said fabric shade is selectively wound thereabout and an extension wing extending substantially the length of said roller and having one end pivotally connected to the outside surface of said roller from which said fabric shade is at least partially supported;

wherein said extension wing is pivotal by means of a pivot mechanism at said one end between a retracted position and an extended position in which said wing extends away from said surface;

wherein said pivot mechanism includes a stop for preventing said extension wing from pivoting beyond said extended position.

* * * * *